US007578746B1

(12) United States Patent
Johnson

(10) Patent No.: US 7,578,746 B1
(45) Date of Patent: Aug. 25, 2009

(54) SWING COVERING ACCESSORY

(76) Inventor: Felicia D. Johnson, 1712 Niagara St., Niagara Falls, NY (US) 14303

( * ) Notice: Subject to any disclaimer, the term of this patent is extended or adjusted under 35 U.S.C. 154(b) by 292 days.

(21) Appl. No.: 11/750,770

(22) Filed: May 18, 2007

Related U.S. Application Data

(60) Provisional application No. 60/891,063, filed on Feb. 22, 2007.

(51) Int. Cl.
*A63G 9/00* (2006.01)
*A47D 13/02* (2006.01)

(52) U.S. Cl. ..... 472/118; 297/485

(58) Field of Classification Search ..... 472/118–125, 472/133, 137; 297/273, 274, 484, 485, 487, 297/467
See application file for complete search history.

(56) References Cited

U.S. PATENT DOCUMENTS 4,037,764 A * 7/1977 Almosnino et al. ..... 224/160
4,382,595 A * 5/1983 Tolar ..... 472/118
5,326,326 A * 7/1994 Cunard et al. ..... 472/118
5,533,934 A * 7/1996 Miller ..... 472/118
5,588,699 A 12/1996 Rundle et al.
5,839,965 A * 11/1998 Mullins ..... 472/118
6,237,998 B1 5/2001 Aprile
7,175,535 B1 * 2/2007 Marmentini ..... 472/118
2001/0048235 A1 12/2001 Hartranft
2002/0150714 A1 10/2002 Digangi
2005/0012366 A1 1/2005 Cohen-Fyffe

* cited by examiner

*Primary Examiner*—Kien T Nguyen
(74) *Attorney, Agent, or Firm*—Crossley Patent Law; Mark A. Crossley

(57) ABSTRACT

A swing covering accessory. The accessory is used to cover an outdoor infant/toddler swing and is designed to be placed into the swing and around the outside of it, providing both entertainment and sanitary purposes for infants and toddlers using the swing. The accessory is sized and shaped to wrap completely around a swing seat and also has separate pieces that are designed to cover the rods at the top of the swing seat and the pair of handles that are within reach of an infant or toddler using the swing seat. The swing covering accessory also has at least one external pocket for holding infant/toddler toys such as a rattler, a teether, squeak toy, or similar items.

10 Claims, 7 Drawing Sheets

SWING COVERING ACCESSORY

BACKGROUND OF THE INVENTION

The present invention concerns that of a new and improved swing covering accessory. The accessory is used to cover an outdoor infant/toddler swing and is designed to be placed into the swing and around the outside of it, providing both entertainment and sanitary purposes for infants and toddlers using the swing.

DESCRIPTION OF THE PRIOR ART

U.S. Pat. No. 5,588,699, issued to Rundle et al., discloses an inflatable safety cushion for a child constructed of a one-piece inflatable structure that allows for the customization of various restraining mechanisms such as swings, car seats, airplane seats, and amusement park rides to accommodate the size of the child.

U.S. application No. 2001/0048235 A1, filed by Hartranft, discloses a cover for child safety seats, and more specifically, to child seat covers that are releasably attached to a child safety seat attached to a shopping cart in order to provide a sanitary and cushioned seating surface for a child.

U.S. application No. 2002/0150714 A1, filed by Digangi, discloses a protective, sanitary cover for use on a shopping cart, infant seat and similar child seating devices.

U.S. application No. 2005/0012366 A1, filed by Cohen-Fyffe, discloses a high chair clean seat for use as a seat cover on a restaurant high chair for the purpose of protecting babies and toddlers from the dirt and bacteria left on the restaurant high chair.

U.S. Pat. No. 6,237,998 B1, issued to Aprile, discloses a shopping cart seat cover having a shopping cart seat cover body made from flexible sheet material.

SUMMARY OF THE INVENTION

The present invention concerns that of a new and improved swing covering accessory. The accessory is used to cover an outdoor infant/toddler swing and is designed to be placed into the swing and around the outside of it, providing both entertainment and sanitary purposes for infants and toddlers using the swing. The accessory is sized and shaped to wrap completely around a swing seat and also has separate pieces that are designed to cover the rods at the top of the swing seat and the parts of the chains that are within reach of an infant or toddler using the swing seat. The swing covering accessory also has at least one external pocket for holding infant/toddler toys such as a rattler, a teether, or similar items.

There has thus been outlined, rather broadly, the more important features of a swing covering accessory that the detailed description thereof that follows may be better understood and in order that the present contribution to the art may be better appreciated. There are, of course, additional features of the swing covering accessory that will be described hereinafter and which will form the subject matter of the claims appended hereto.

In this respect, before explaining at least one embodiment of the swing covering accessory in detail, it is to be understood that the swing covering accessory is not limited in its application to the details of construction and to the arrangements of the components set forth in the following description or illustrated in the drawings. The swing covering accessory is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present swing covering accessory. It is important, therefore, that the claims be regarded as including such equivalent constructions insofar as they do not depart from the spirit and scope of the present invention.

It is therefore an object of the present invention to provide a swing covering accessory which has all of the advantages of the prior art and none of the disadvantages.

It is another object of the present invention to provide a swing covering accessory which may be easily and efficiently manufactured and marketed.

It is another object of the present invention to provide a swing covering accessory which is of durable and reliable construction.

It is yet another object of the present invention to provide a swing covering accessory which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
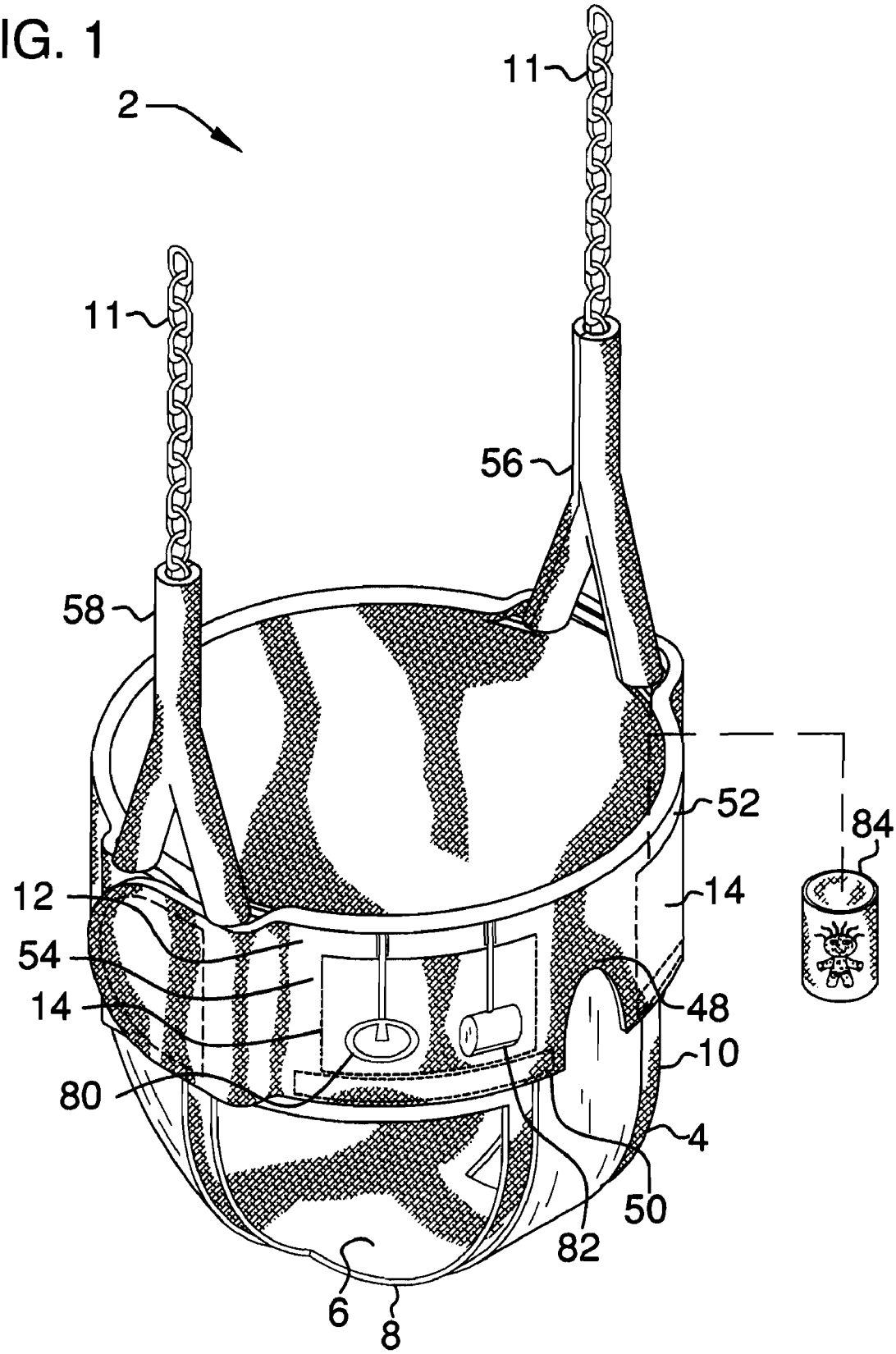
FIG. 1 shows a perspective view of the swing covering accessory as it would appear in use attached to a swing seat.
Figure 2:
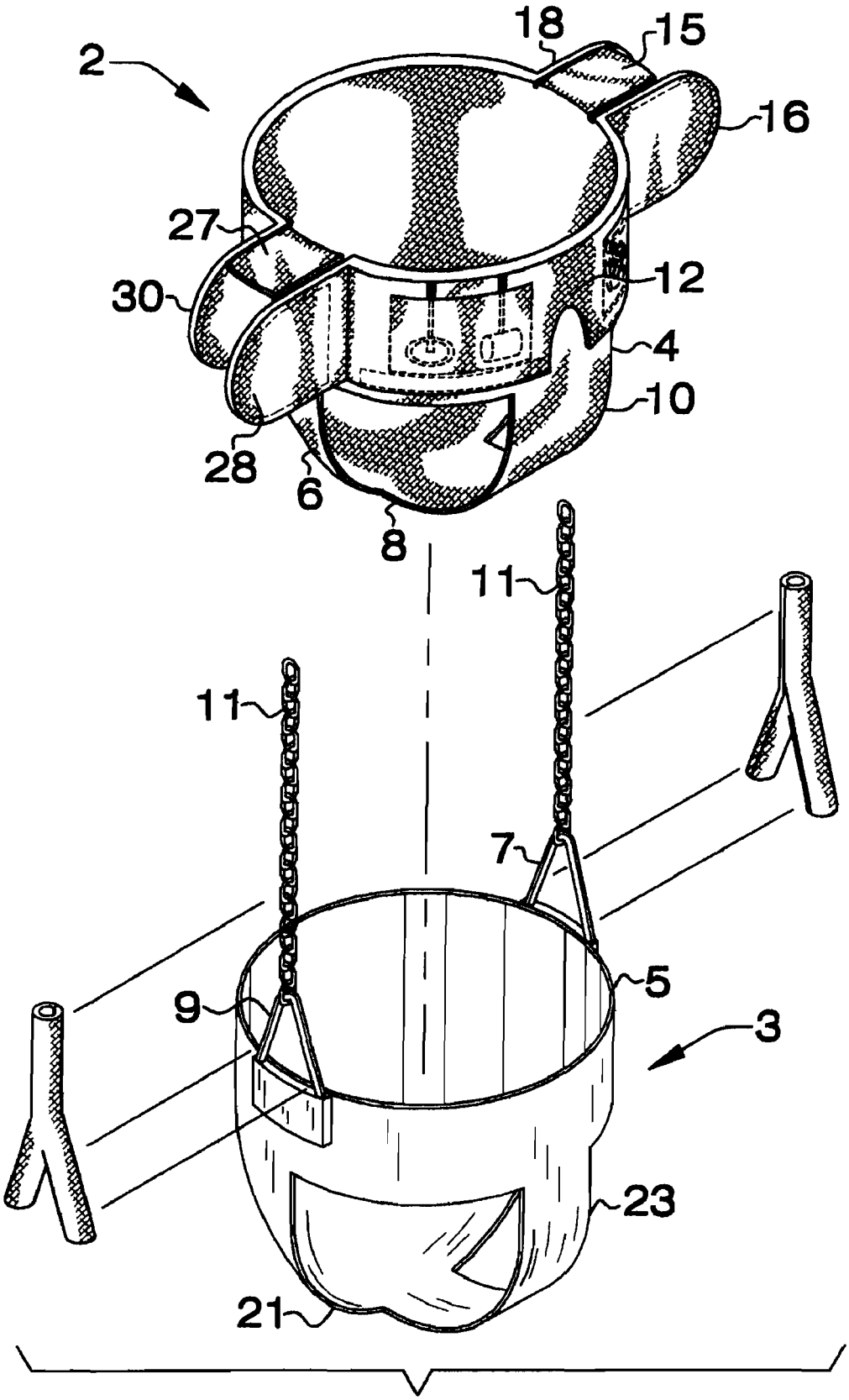
FIG. 2 shows a perspective view of the swing covering accessory and a swing seat, highlighting the mechanism as to how the swing covering accessory would be placed on the swing seat.
Figure 3:
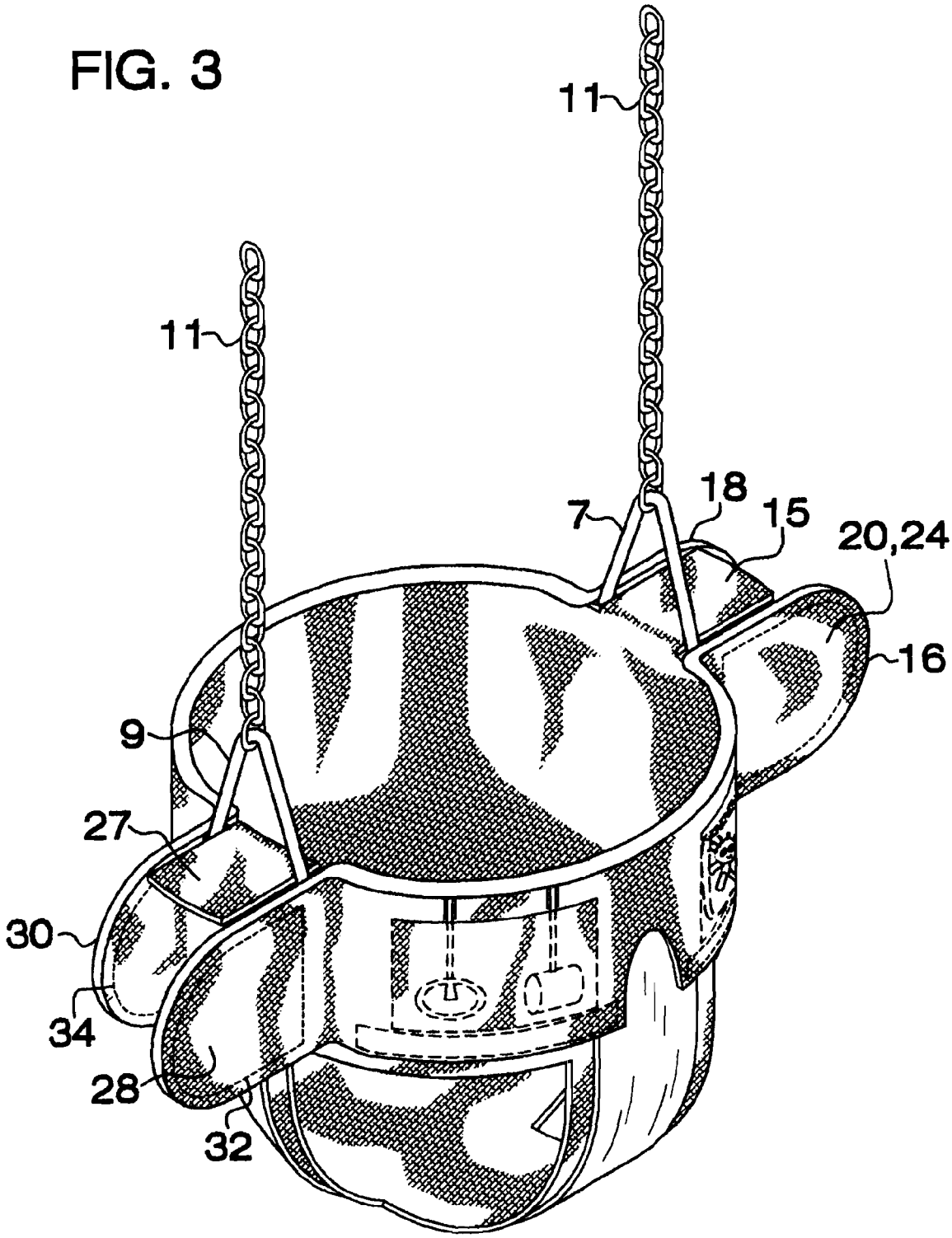
FIG. 3 shows a perspective view of the swing covering accessory as it would appear in use attached to a swing seat prior to the handle coverings have been attached.
Figure 4:
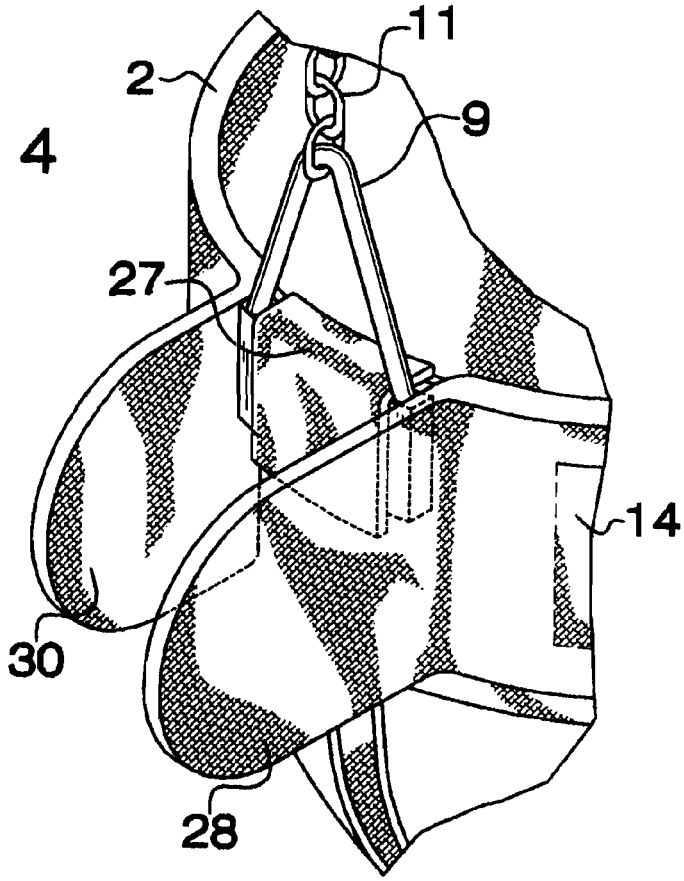
FIG. 4 shows a perspective close-up view of the side flaps that are designed to removably attach the swing covering accessory to the swing seat before the side flaps have been secured.
Figure 5:
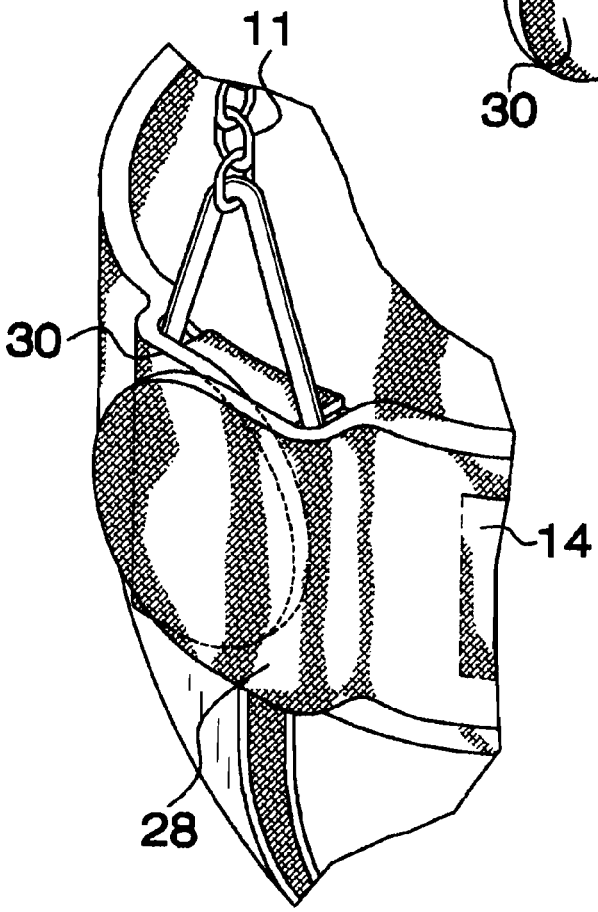
FIG. 5 shows a perspective close-up view of the side flaps that are designed to removably attach the swing covering accessory to the swing seat after the side flaps have been secured.

With reference now to the drawings, and in particular to FIGS. 1 through 9 thereof, a new swing covering apparatus embodying the principles and concepts of the present invention and generally designated by the reference numeral 2 will be described.

As best illustrated in FIGS. 1 through 9, the swing covering apparatus 2 comprises a seat 4 that is placed in a swing 3. The seat 4 comprises a base 6 which has two cutouts comprising a right cutout 8 and a left cutout 10. The two cutouts are designed to be used for insertion of a child's legs when the swing covering apparatus 2 is in use with a swing 3.

The swing 3 that is used in conjunction with the swing covering apparatus 2 needs to have an upper edge 5 to work properly with the swing covering apparatus 2. In addition, the swing 3 also has a pair of cutouts comprising a right cutout 21 and a left cutout 23. The right cutout 8 on the base 6 is designed to overlap the right cutout 21 on the swing 3, while the left cutout 10 on the base 6 is designed to overlap the left cutout 23 on the swing 3. Furthermore, the swing 3 preferably has a pair of handles comprising a left handle 7 and a right handle 9, with these handles being connected to lengths of holding chain 11.

Figure 6:
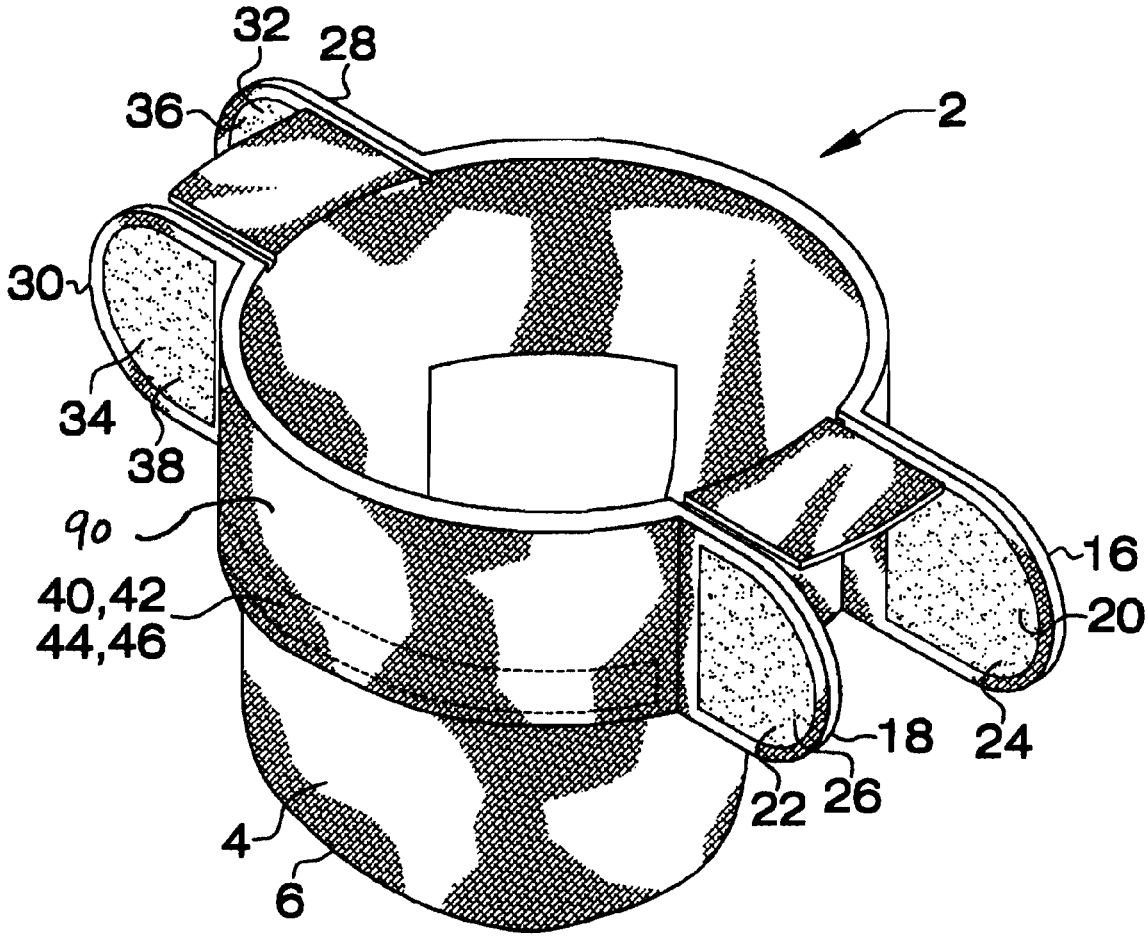
FIG. 6 shows a perspective close-up view of the side flaps that are designed to removably attach the swing covering accessory to the swing seat before the side flaps have been secured, highlighting the hook and loop attachments that they use to be secured to each other.
Figure 7:
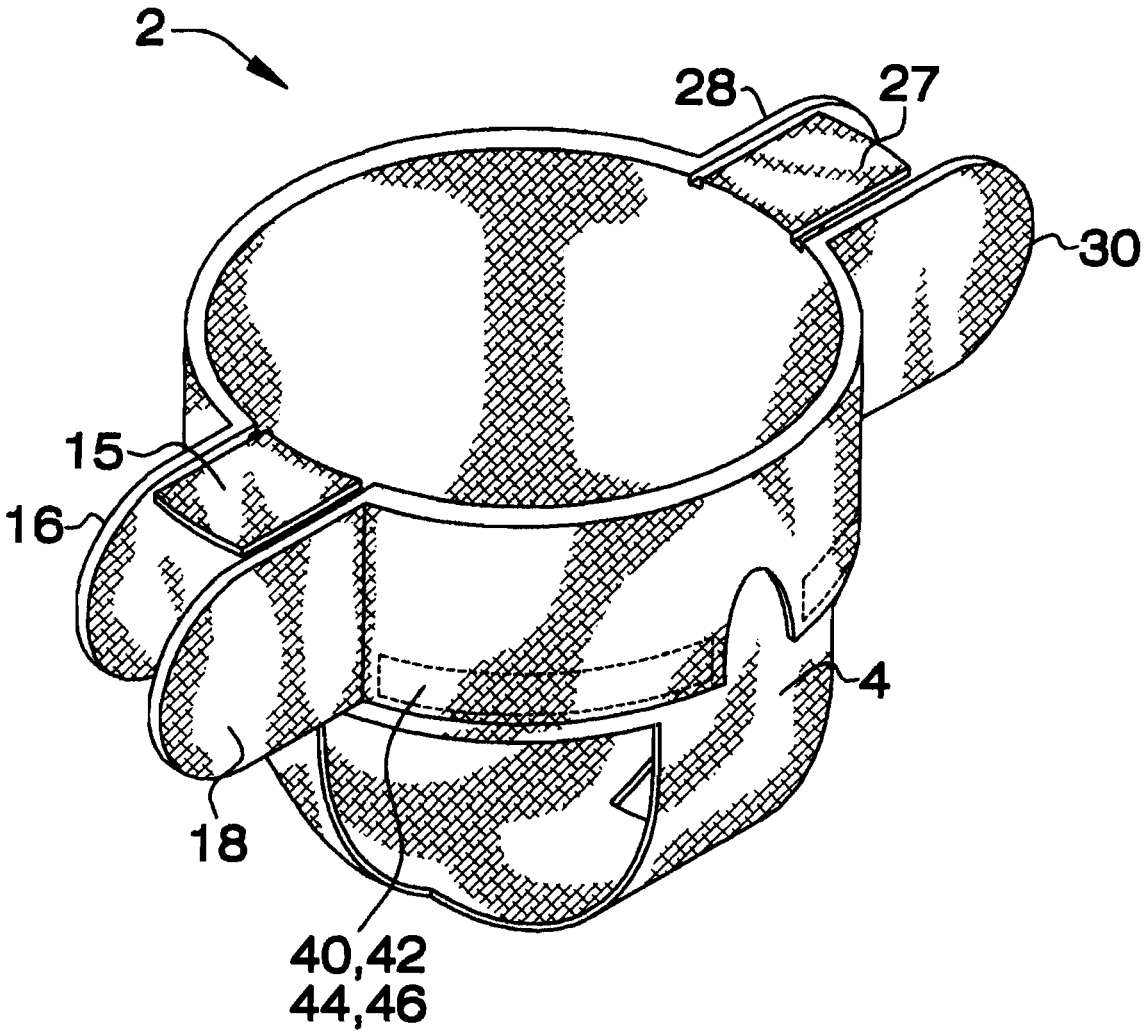
FIG. 7 shows a rear perspective view of an alternative embodiment of a swing covering accessory as it would appear prior to being attached to a swing seat.
Figure 8:
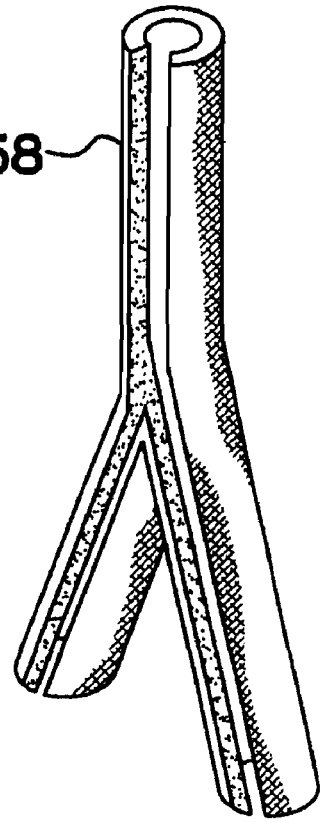
FIG. 8 shows a perspective view of a handle covering that is part of the swing covering accessory.
Figure 9:
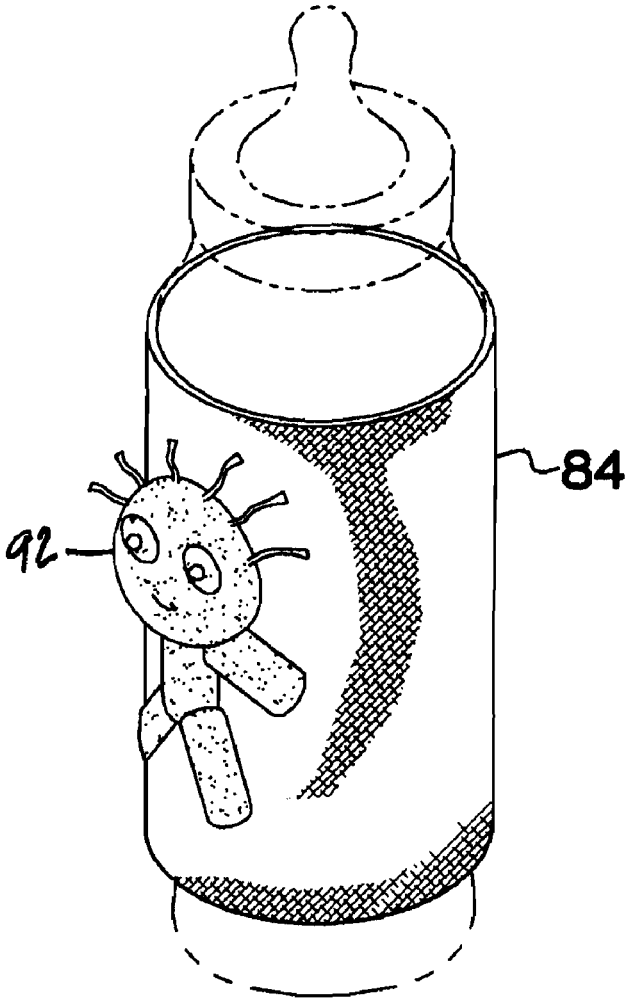
FIG. 9 shows a perspective view of a potential add-on component to the swing covering accessory.

Attached to the base 6 portion of the seat 4 is a front overlap 12. When the seat 4 is placed within the swing 3, the front overlap 12 is designed to be placed "up and over" the upper edge 5 of the swing 3. The front overlap 12 preferably has at least two pockets 14 and has two surfaces comprising a front surface 48 and a rear surface 50. Furthermore, the front overlap 12 has two sections comprising a left section 52 and a right section 54. Also, a rear overlap 90 covers the rear of an exemplary swing 3, as shown in FIG. 6.

When the seat 4 is first placed over a swing 3, the first thing that should be done is to cover the areas in which the handles 7 and 9 connect to the seat 4. Therefore, left upper flap 15 is folded down and subsequent to this, left front flap 16 and left rear flap 18 are joined together. Left front flap 16 is connected to the left section of the front overlap 12, while left rear flap 18 is connected to the base 6 of the seat 4.

Left front flap 16 and left rear flap 18 each have two surfaces comprising a front surface and a rear surface. The rear surface of left front flap 16 has patch 20 on it, while the rear surface of left rear flap 18 has patch 22 on it. Patch 20 comprises a first plurality of attachment objects 24, while patch 22 comprises a second plurality of attachment objects 26. Between the first plurality of attachment objects 24 and the second plurality of attachment objects 26, one of these pluralities comprises a plurality of hooks and the other plurality comprises a plurality of loops. To properly attach these to one another, the left rear flap 18 is folded forward first over left upper flap 15, and then, left front flap 16 is folded backward until patch 20 makes contact with patch 22. These two patches and their two pluralities of attachment objects together make a "hook and loop" attachment system.

Next, right upper flap 27 is folded down and subsequent to this, right front flap 28 and right rear flap 30 are joined together. Right front flap 28 is connected to the right section of the front overlap 12, while right rear flap 30 is connected to the base 6 of the seat 4.

Right front flap 28 and right rear flap 30 each have two surfaces comprising a front surface and a rear surface. The rear surface of right front flap 28 has patch 32 on it, while the rear surface of right rear flap 30 has patch 34 on it. Patch 32 comprises a first plurality of attachment objects 36, while patch 34 comprises a second plurality of attachment objects 38. Between the first plurality of attachment objects 36 and the second plurality of attachment objects 38, one of these pluralities comprises a plurality of hooks and the other plurality comprises a plurality of loops. To properly attach these to one another, the right rear flap 30 is folded forward first over right upper flap 27, and then, right front flap 28 is folded backward until patch 32 makes contact with patch 34. These two patches and their two pluralities of attachment objects together make a "hook and loop" attachment system.

In addition, there must also be attachment means for attaching the rear surface of the front overlap 12 to the base 6 of the seat 4. Therefore, the front overlap 12 has a plurality of internal front patches 40 that are attached to the rear surface 50 of the front overlap 12, and furthermore, the base 6 of the seat 4 has a plurality of attached external front patches 42 which are designed to "match up" with each of the internal front patches 40 that are present. Each of the internal front patches 40 has a first plurality of attachment objects 44 on it, while each of the external front patches 42 has a second plurality of attachment objects 46 on it.

Between the first plurality of attachment objects 42 and the second plurality of attachment objects 44, one of these pluralities comprises a plurality of hooks and the other plurality comprises a plurality of loops. Each set of matching patches 40 and 42 together make a "hook and loop" attachment system. There are preferably at least two sets of these systems in use in the swing covering apparatus 2.

Also in use with the present invention is a pair of handle coverings comprising a left handle covering 56 and a right handle covering 58. These handles coverings are used to cover the left handle 7 and right handle 9, respectively, and are designed to provide additional security and sanitary control to the swing covering apparatus 2.

The swing covering apparatus 2 also further comprises a teether 80 and a rattler 82 which are located within the pockets 14. Furthermore, a bottle covering 84 is preferably placed within a pocket 14 to allow an infant or toddler to cover a drinking bottle when it is in use and to keep an infant's hands from becoming cold or wet as the infant holds the bottle. Bottle covering 84 further comprises a squeak toy 92. Said squeak toy 92 may appear in various forms appealing to an infant, such as a boy's face, girl's face, and animal or the like.

Said swing covering apparatus 2 may be provided in either a non-disposable version or a disposable version, such disposable version being formed of thin cotton material and without pockets 14, bottle covering 84, teether 80, rattler 82, or squeak toy 92.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A swing covering apparatus in combination with a swing, the swing including a swing seat having an upper edge, the swing further comprising a pair of handles comprising a left handle and a right handle, the swing covering apparatus comprising:

(a) a seat, the seat comprising a base, (b) a pair of cutouts in the base, the pair of cutouts comprising a right cutout and a left cutout, (c) a front overlap attached to the base, the front overlap looped over the upper edge of the swing seat, the front overlap having two surfaces comprising a front surface and a rear surface, the front overlap also having two sections comprising a left section and a right section, (d) means for securing the seat to the swing seat, (e) means for covering the handles of the swing with the swing covering apparatus, and (f) means for securing the front overlap to the base.

2. A swing covering apparatus in combination with a swing according to claim 1 wherein the means for securing the front overlap to the base further comprises:

(a) at least one internal front patch located on the rear surface of the front overlap, (b) at least one external front patch located on the rear surface of the front overlap, (c) a first plurality of attachment objects located on each internal front patch, (d) a second plurality of attachment objects located on each external front patch, (e) wherein each internal front patch will have a corresponding external front patch, (f) further wherein between each pairing of front patches, one of the pluralities of attachment objects will comprise a plurality of hooks and the other plurality of attachment objects will comprise a plurality of loops, (g) further wherein placing one external front patch against its paired internal front patch will cause the said external front patch to become removably attached to the paired internal patch.

3. A swing covering apparatus in combination with a swing according to claim 2 wherein the means for covering the handles of the swing with the swing covering apparatus further comprises (a) a pair of handle coverings comprising a left handle covering and a right handle covering, (b) wherein the left handle covering is placed over the left handle on the swing, and (c) further wherein the right handle covering is placed over the right handle on the swing.

4. A swing covering apparatus in combination with a swing according to claim 3 wherein the means for securing the seat to the swing seat further comprises:

(a) a left upper flap attached to the base of the seat, (b) a left front flap attached to the left section of the front overlap, the left front flap having two surfaces comprising a front surface and a rear surface, (c) a left rear flap attached to the base of the seat, the left rear flap having two surfaces comprising a front surface and a rear surface, (d) a first patch located on the rear surface of the left front flap, (e) a second patch located on the rear surface of the left rear flap, (f) a first plurality of attachment objects located on the first patch, (g) a second plurality of attachment objects located on the second patch, (h) further wherein between the two patches located on the left front flap and left rear flap, one of the pluralities of attachment objects will comprise a plurality of hooks and the other plurality of attachment objects will comprise a plurality of loops, (i) further wherein the left upper flap is folded down first, (j) further wherein the left rear flap is folded forward, and (k) further wherein the left front flap is folded against the left rear flap, causing the first patch located on the rear surface of left front flap to be placed into contact with the second patch located on the rear surface of left rear flap, causing the two patches to become removably attached to one another.

5. A swing covering apparatus in combination with a swing according to claim 4 wherein the means for securing the seat to the swing seat further comprises:

(a) a right upper flap attached to the base of the seat, (b) a right front flap attached to the right section of the front overlap, the right front flap having two surfaces comprising a front surface and a rear surface, (c) a right rear flap attached to the base of the seat, the right rear flap having two surfaces comprising a front surface and a rear surface, (d) a first patch located on the rear surface of the right front flap, (e) a second patch located on the rear surface of the right rear flap, (f) a first plurality of attachment objects located on the first patch, (g) a second plurality of attachment objects located on the second patch, (h) further wherein between the two patches located on the right front flap and right rear flap, one of the pluralities of attachment objects will comprise a plurality of hooks and the other plurality of attachment objects will comprise a plurality of loops, (i) further wherein the right upper flap is folded down first, (j) further wherein the right rear flap is folded forward, and (k) further wherein the right front flap is folded against the right rear flap, causing the first patch located on the rear surface of the right front flap to be placed into contact with the second patch located on the rear surface of right rear flap, causing the two patches to become removably attached to one another.

6. A swing covering apparatus in combination with a swing according to claim 5 wherein the front overlap comprises at least one pocket, the pocket being located on the front surface of the front overlap.

7. A swing covering apparatus in combination with a swing according to claim 6 wherein the apparatus further comprises at least one baby toy, the baby toy being placed within the pocket located on the front surface of the front overlap.

8. A swing covering apparatus in combination with a swing according to claim 7 wherein the baby toys placed within the pocket located on the front surface of the front overlap further comprises (a) a teether placed within a pocket, and (b) a rattler placed within a pocket.

9. A swing covering apparatus in combination with a swing according to claim 8 wherein the apparatus further comprises a baby bottle covering, the baby bottle covering being placed within a pocket.

10. A swing covering apparatus in combination with a swing according to claim 9 wherein said baby bottle covering further comprises a squeak toy.

* * * * *